US006349759B1

(12) United States Patent
Wheaton

(10) Patent No.: US 6,349,759 B1
(45) Date of Patent: Feb. 26, 2002

(54) APPARATUS AND METHOD FOR CASTING A METAL ARTICLE

(75) Inventor: Harold L. Wheaton, Bowerston, OH (US)

(73) Assignee: PCC Airfoils, Inc., Cleveland, OH (US)

( * ) Notice: Subject to any disclaimer, the term of this patent is extended or adjusted under 35 U.S.C. 154(b) by 0 days.

(21) Appl. No.: 09/286,403

(22) Filed: Apr. 5, 1999

(51) Int. Cl.[7] ..... B22C 9/02
(52) U.S. Cl. ..... 164/361; 164/366; 164/411
(58) Field of Search ..... 164/516, 122.1, 164/361, 122.2, 411, 366, 367

(56) References Cited

U.S. PATENT DOCUMENTS

| | | | | |
|---|---|---|---|---|
| 2,651,823 A | | 9/1953 | Hohlfelder | |
| 4,596,281 A | | 6/1986 | Bishop | 164/32 |
| 4,811,778 A | * | 3/1989 | Allen et al. | 164/516 |
| 5,505,250 A | | 4/1996 | Jago | 164/516 |
| 5,623,985 A | | 4/1997 | Wheaton et al. | 164/516 |
| 5,924,483 A | * | 7/1999 | Frasier | 165/154 |

* cited by examiner

*Primary Examiner*—Nam Nguyen
*Assistant Examiner*—I.-H. Lin
(74) *Attorney, Agent, or Firm*—Tarolli, Sundheim, Covell, Tummino & Szabo L.L.P.

(57) ABSTRACT

To form a mold for casting a metal article, metal pins are inserted through a pattern. End portions of the metal pins are bent after the pins have been inserted through the pattern. The pattern and opposite end portions of the metal pins are then covered with wet ceramic mold material. A mold structure is formed by drying the wet ceramic mold material. The pattern is then removed from the mold structure to leave a mold cavity with the metal pins extending through the metal cavity between opposite side sections of the mold structure. Molten metal is conducted into the mold cavity and force is transmitted between opposite side sections of the mold structure through the metal pins to retard movement between the side sections of the mold structure. The molten metal is solidified in the mold cavity and a metallurgical bond is formed between the metal in the mold cavity and the metal pins. The cast article is then removed from the mold structure. The cast article has a thin wall section with a thickness of 0.060 inches or less. The metal pins have cylindrical outer side surfaces with a diameter of 0.030 inches or less.

5 Claims, 2 Drawing Sheets

APPARATUS AND METHOD FOR CASTING A METAL ARTICLE

BACKGROUND OF THE INVENTION

The present invention relates to a new and improved method and apparatus for use in casting a metal article and more specifically to a method and apparatus which may be used in casting of a thin metal article.

Thin wall equiaxed castings are used as turbine exhaust case components in jet engines. The thin wall castings typically have a thickness of 0.020 to 0.030 inches and may be 40 to 150 square inches in size. They frequently have stiffening ribs to impart adequate rigidity and may contain threaded attachment studs, pads for bolt holes and/or end wall flanges.

Although this type of thin wall casting has been made using a lost wax process and a vacuum casting process, it has not been possible to obtain adequate dimensional control of the wall, that is control of up to plus or minus 0.005 inches. Previous attempts to make these thin wall castings have resulted in wall thicknesses of 0.015 inches or less to 0.06 inches or more. This poor dimensional control of the wall thickness of objectionable.

One known method of casting a thin walled metal article is disclosed in U.S. Pat. No. 5,623,985. This patent discloses the concept of using ceramic pins to stabilize side sections of a mold structure. The ceramic pins leave small holes in the thin wall cast article. These small holes may, in some circumstances at least, be objectionable.

SUMMARY OF THE INVENTION

The present invention provides a new and improved method and apparatus for use in casting a metal article. The apparatus includes a mold structure having one or more metal pins which extend between wall sections of the mold structure. Bent end portions of the pins are disposed in the mold wall sections. Central or connector portions of the pins are disposed in the mold cavity and extend between the mold wall sections. Force is transmitted through the pins to retard relative movement between the mold wall sections during casting of the metal article.

Although the method and apparatus of the present invention may be utilized to cast many different types of articles, it is believed that the apparatus will be particularly advantageous for forming of castings having thin wall areas. Thus, the method and apparatus may be used to cast a metal article having thin wall areas with a thickness of 0.060 inches or less. The thin wall article has a length and width of at least four inches or more. Although the metal pins may have many different dimensions, it may be preferred to use metal pins having a thickness of 0.030 inches or less.

BRIEF DESCRIPTION OF THE DRAWINGS

The foregoing and other features of the invention will become more apparent upon a consideration of the following description taken in connection with the accompanying drawings wherein.

DESCRIPTION OF ONE SPECIFIC PREFERRED EMBODIMENT OF THE INVENTION

Figure 1:
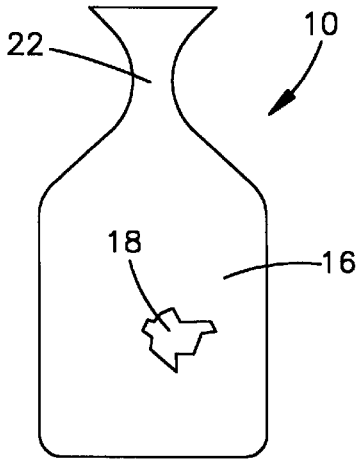
FIG. 1 is a fragmentary schematic illustration of a ceramic mold structure used to cast a metal article having thin wall areas.
Figure 2:
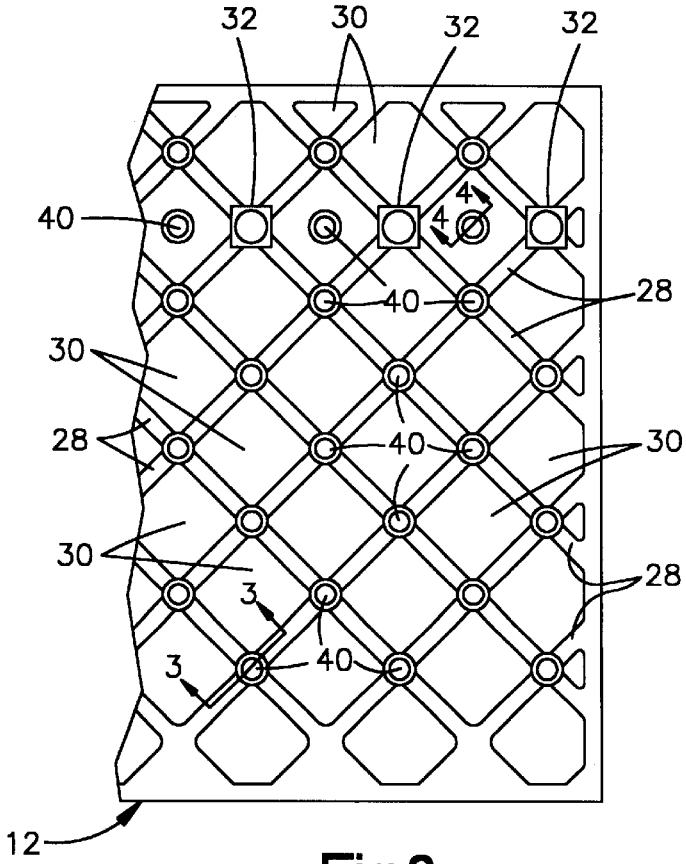
FIG. 2 is a fragmentary illustration of a metal panel cast using the method and apparatus of the present invention and having thin wall areas.

A mold structure 10 (FIG. 1) is used to cast a thin metal panel or article 12 (FIG. 2). The mold structure 10 (FIG. 1) includes an article mold 16 an article mold cavity 18 in which the thin metal panel or article 12 is cast. The article mold cavity 18 has a configuration which corresponds to the configuration of the thin metal panel 12. Of course, if a different article was to be cast, such as an airfoil, the article mold cavity 18 would have a configuration corresponding to the configuration of the article to be cast.

A pour cup 22 is connected with the upper portion of the article mold 16 and is connected in fluid communication with the article mold cavity 18. In the illustrated embodiment of the invention, the thin metal panel 12 is cast with an equiaxed crystallographic structure. However, it should be understood that the thin metal panel 12 could be cast with a different crystallographic structure if desired. For example, the thin metal panel 12 could be formed with a single crystal or a columnar grained crystallographic structure if desired. Of course, the mold structure 10 would have a known construction which would be a function of the selected crystallographic structure for the thin metal panel 12.

The thin metal panel 12 has a generally rectangular configuration with a length of at least four inches and a width of at least four inches so that the thin metal panel 12 has an overall area of at least sixteen square inches. In the embodiment of the thin metal panel 12 illustrated in FIG. 2, the panel is intended for use as a component of a turbine exhaust case in a jet engine. For this particular use, the thin metal panel 12 may have an area of 40 to 150 square inches. However, it should be understood that the method and apparatus of the present invention may be used to cast many different articles other than the thin metal panel 12.

In the particular embodiment of the thin metal panel 12 illustrated in FIG. 2, stiffening ribs 28 are provided in a generally rectangular array across the panel and around the edges of the panel. Thin wall areas 30 are disposed between the stiffening ribs 28. Pads for boltholes have been schematically illustrated at 32 on the thin panel 12.

Although it is contemplated that the thin panel 12 could have many different constructions and may or may not be provided with the stiffening ribs 28, the thin metal panel has a thickness of 0.060 inches or less. In the illustrated embodiment of the thin metal panel 12, the thin wall areas 30 have a thickness which is selected from a range of 0.020 to 0.030 inches. The ribs 28 have a thickness in a range of 0.040 to 0.060 inches. In one specific preferred embodiment of the thin metal panel 12, the thin wall areas had a thickness of 0.025 inches and the ribs 28 had a thickness of 0.050 inches. The present invention allows the thin metal panel to be cast with dimensions which are within a range of ±0.005 inches or less from selected dimensions for the panel.

To enable the thin metal panel 12 to be cast with dimensions within a tolerance range of ±0.005 inches, the mold structure 10 has a thin shell. If the mold structure 10 was constructed with a thick shell, the mold structure would tend to crack the thin metal panel 12 during the casting operation. By forming the mold structure 10 with a thin shell, the mold structure has a relatively low elastic modulus and is easily flexed. However, flexing of opposite side sections of the mold structure 10 away from each other can result in an oversized casting while flexing of the opposite side sections of the mold structure toward each other can pinch or reduce the thickness of the thin metal panel. With a mold structure 10 having a thin ceramic shell, stresses causing flexing of the mold structure can result from investing materials and/or mold handling.

The mold structure 10 illustrated schematically in FIG. 1 has a relatively simple construction. It is contemplated that the mold structure 10 could, and probably will, have a more complex construction than the construction illustrated in FIG. 1. For example, the mold structure 10 could include a plurality of core sections enclosed by outer wall sections. If desired, the mold structure 10 could include gating which interconnects a plurality of article mold cavities. If the mold structure 10 is utilized to form a thin metal panel with a single crystal or columnar grained crystallographic structure, the construction of the mold structure may be complicated in order to impart the desired crystallographic structure to the thin metal panel 12.

Figure 3:
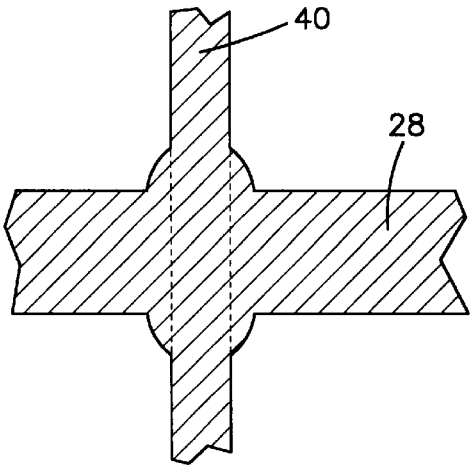
FIG. 3 is a fragmentary sectional view, taken generally along the line 3—3 of FIG. 2, illustrating how a metallurgical bond is formed between a metal retainer pin and a rib of the thin metal panel of FIG. 2.
Figure 4:
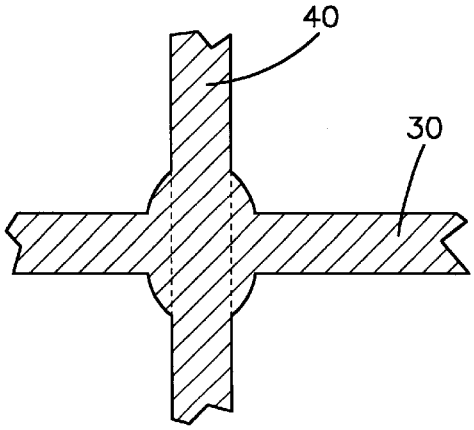
FIG. 4 is a fragmentary sectional view, taken generally along the line 4—4 of FIG. 2, illustrating how a metallurgical bond is formed between a metal retainer pin and a thin wall area of the thin metal panel of FIG. 2.

In accordance with a feature of the present invention, metal retainer pins 40 (FIGS. 2–4) are provided in association with both the ribs 28 (FIG. 2) and the thin wall areas 30 (FIG. 4). The metal retainer pins 40 are connected with opposite mold wall sections 44 and 46 (FIG. 5) of the mold structure 10. The metal retainer pins 40 transmit force between the mold wall sections 44 and 46 to prevent relative movement between the mold wall sections during casting of the thin metal panel 12.

In the embodiment of the thin metal panel 12 illustrated in FIG. 2, the metal retainer pins 40 extend from opposite sides of the thin metal panel 12 at junctions between the ribs 28 (FIGS. 2 and 3). In addition, the metal retainer pins 40 extend from opposite sides of the thin wall areas 30 (FIG. 4). In the embodiment of the thin metal panel 12 illustrated in FIG. 2, the metal retainer pins 40 extend from opposite sides of the thin wall sections 30 at locations adjacent to the pads 32.

It should be understood that the metal retainer pins 40 could be provided at other locations in the thin metal panel 12 if desired. For example, the metal retainer pins could be provided at the pads 32 and/or could be provided at all of the thin wall areas 30 if desired. The specific number and location of the metal retainer pins 40 relative to a thin metal panel 12 will depend upon the specific structure and size of the thin metal panel. For example, if the ribs 28 are omitted from the thin metal panel 12, all of the metal retainer pins would extend through the thin wall areas 30. Alternatively, if a rectangular grid of relatively closely spaced ribs 28 is provided on the thin metal panel 12, in a manner similar to that illustrated in FIG. 2, all of the metal retainer pins 40 could be provided at junctions between the ribs.

The metal retainer pins 40 all have the same construction. The metal retainer pins 40 are formed from straight cylindrical rods or wires having a diameter of 0.030 inches or less. The pins 40 of FIGS. 2–7 have a thickness or diameter of 0.020 inches. However, it should be understood that the pins 40 could be formed with either a greater or lesser thickness if desired.

The pins 40 are formed of a metal which will form a metallurgical bond with the metal forming the thin panel 12. In order to enable the metallurgical bond to be formed between the metal pins 40 and the thin metal panel 12, the pins are formed of platinum which does not oxidize during preheating of the mold structure 10. It is contemplated that alloys of platinum may be used to reduce the cost of the pins.

When the thin metal panel 12 is to be cast, a pattern 50 (FIG. 5) having the same configuration as the desired configuration of the panel 12 is formed. The pattern 50 may be injection molded of either natural or synthetic wax, other polymeric materials, or other known pattern forming materials. It is believed that it may be preferred to form the pattern 50 by injecting hot wax under pressure into a metal mold having a cavity with a configuration which corresponds to the desired configuration of the pattern 50 and the thin metal panel 12. Since the pattern 50 is formed in a permanent rigid metal mold, the pattern 50 can be accurately dimensioned to have a configuration and dimensions corresponding to the desired configuration and dimensions of the thin metal panel 12.

Once the wax pattern 50 has been formed, straight cylindrical metal retainer pins 40 are inserted through the pattern 50. The straight cylindrical metal retainer pins 40 are inserted through the pattern 50 with a longitudinal central axes of the retainer pins extending perpendicular to opposite side surfaces 52 and 54 of the wax pattern 50. The side surfaces 52 and 54 of the wax pattern may be disposed on a portion of the wax pattern corresponding to the ribs 28 on the thin metal panel 12 (FIG. 2) and/or on portions of the wax pattern 50 corresponding to the thin wall areas 30 on the thin metal panel 12. The straight metal retainer pins 40 (FIG. 5) have an overall length of approximately 0.5 inches to 0.6 inches and a diameter of approximately 0.020 inches throughout their length.

Figure 5:
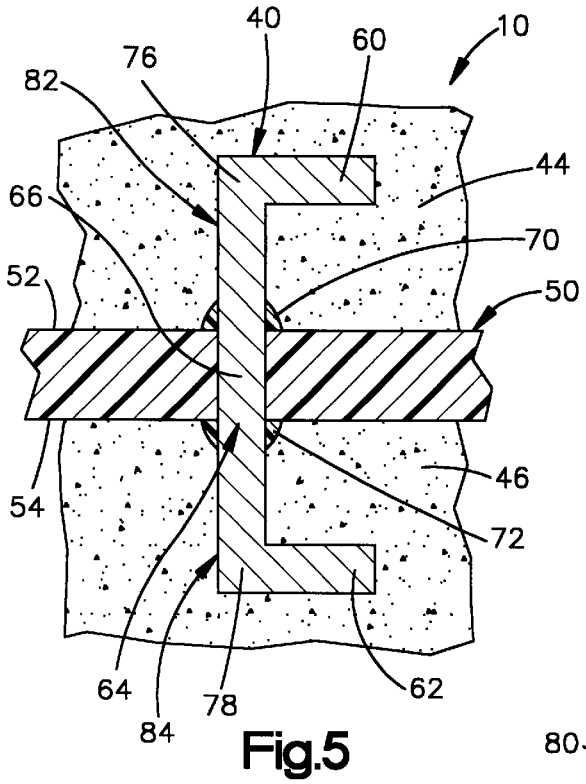
FIG. 5 is a fragmentary schematic illustration depicting the manner in which a thin metal retainer pin is inserted through a wax pattern and has bent end portions which are embedded in opposite side wall sections of a ceramic mold structure.

Opposite end portions of the metal retainer pins 40 are then bent to form legs 60 and 62 which extend parallel to the opposite side surfaces 52 and 54 of the pattern 50 (FIG. 5). A straight main or central section 64 of the metal retainer pin 40 extends between the legs 60 and 62. A portion 66 of the main or central section 64 is disposed in and is enclosed by the pattern 50. A pair of wax beads 70 and 72 are placed where the main or central portion 64 of the bent metal retainer pin 40 extends through the opposite side surfaces 52 and 54 of the pattern 50.

In the schematic illustration of the metal retainer pin 40 shown in FIG. 5, the main or central section 64 of the pin is connected with the opposite leg sections 60 and 62 at sharp right angle bends 76 and 78. It should be understood that the bends 76 and 78 have been illustrated schematically in FIG. 5 and will actually have a more rounded configuration than the sharp square configuration illustrated in FIG. 5. It should also be understood that a plurality of bends could be formed in the metal retainer pin 40 if desired. Although the leg sections 60 and 62 have been shown as having straight configurations and extending perpendicular to the main or central section 64 of the pin 40, the leg sections could, themselves, have bends or otherwise be formed with an irregular configuration. For example, the leg sections 60 and 62 could have a zig-zag configuration if desired.

In the embodiment of the metal retainer pin 40 illustrated in FIGS. 1–7, the metal retainer pin has a circular cross sectional configuration throughout its length. However, it is contemplated that the metal retainer pin could be provided with a different cross sectional configuration if desired. For example, the metal retainer pin 40 could be provided with a rectangular cross sectional configuration.

Once a plurality of the metal retainer pins 40 have been inserted through the pattern 50 and bent, in the manner illustrated in FIG. 5 for one of the pins, the pattern is covered with a coating of wet ceramic mold material. The wet ceramic mold material covers the surfaces 52 and 54 of the pattern and covers the exposed portions of the metal pins 40. Thus, the entire metal pin, with the exception of the portion 66 disposed in the pattern 50, is covered by the wet ceramic mold material. The entire pattern 50 may be covered with the wet ceramic mold material by repetitively dipping the pattern and the pins 40 in a slurry of liquid ceramic mold material. However, it is believed that it will be desired to minimize the number of layers of wet ceramic mold material applied to the pattern 50 in order to form a relatively thin layer of wet ceramic mold material over the pattern.

Although many different types of slurries of the ceramic mold material could be utilized, one illustrative slurry contains fused silica, zircon and other refractory materials in combination with binders. Chemical binders such as ethyl silicate, sodium silicate and colloidal silica can be utilized. In addition, the slurry may contain suitable film formers such as alginates, to control viscosity and wetting agents to control flow characteristics and pattern wettability.

Alternatively, the ceramic slurry which forms the mold material could have the composition disclosed in U.S. Pat. No. 4,947,927 issued Aug. 14, 1990 and entitled "Method of Casting a Reactive Metal Against a Surface Formed From an Improved Slurry Containing Yttria". It is believed that the ceramic slurry disclosed in the aforementioned U.S. Pat. No. 4,947,927 may be particularly advantageous when the thin metal panel 12 or other article is to be formed of a reactive metal, such as titanium or a nickel-chrome super alloy. Of course, other known ceramic slurries could be used if desired and it is not intended to limit the present invention to any one particular slurry.

The wax pattern 50 and metal retainer pins 40 are repetitively dipped in the ceramic slurry until a coating of wet ceramic mold material has been formed over the pattern and the metal retainer pins having a desired thickness. The wet coating of ceramic mold material completely encloses the portions of the metal retainer pins 40 which project from the pattern 50. After the wet ceramic mold material has been at least partially dried, the mold structure 10 is heated to melt the wax material of the pattern 50.

The melted wax of the pattern is poured out of the mold structure 10 through the open end of the pour cup 22. Although the mold structure 10 has been shown as having only a single article mold 16 connected with a single pour cup 22, it is contemplated that the mold structure 10 could constructed in such a manner as to have a plurality of article molds connected with a single pour cup 22 by suitable gating constructed in a known manner.

After the wax pattern material has been removed from the mold structure 10, the mold structure is fired at a temperature of approximately 1,900° F. for a time sufficient to cure the mold structure. During firing of the mold structure 10, the opposite end portions of the retainer pins 60 are fixedly embedded in the ceramic material of the mold wall sections 44 and 46. Thus, the leg sections 60 and 62 of the retainer pins 40 and the portions of the central section 64 extending from the bends 76 and 78 are gripped by the ceramic material of the mold wall sections. Upon subsequent drying and firing of the ceramic mold material, the opposite end portions of the metal retainer pins 40 are embedded in the hardened ceramic mold material of the wall sections 44 and 46 to interlock the retainer pins and the mold structure 10.

Figure 6:
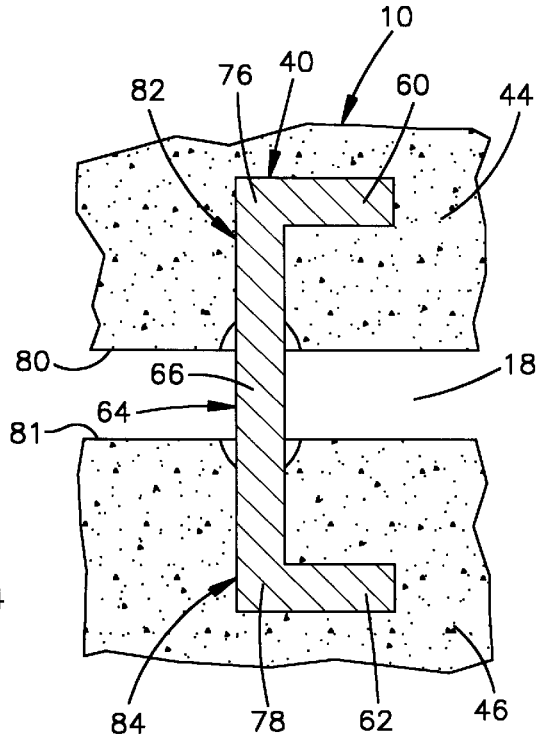
FIG. 6 is a fragmentary schematic illustration depicting the manner in which the pattern is removed to leave a mold cavity in the mold structure of FIG. 1 with a metal retainer pin extending across the mold cavity.

Main or central sections 64 of the retainer pins 40 extend across the space corresponding to the mold cavity 18 (FIG. 6). Thus, the portion 66 of each of the metal pins 40, that is, the portion of the metal pin which was previously enclosed by the pattern 50 and wax beads 70 and 72 (FIG. 5), extends across the space between flat side surfaces 80 and 81 on the mold wall sections 44 and 46. Opposite end sections 82 and 84 of the metal retainer pins 40 are fixedly embedded in and securely gripped by the hardened ceramic mold material of the mold wall sections 44 and 46. The bends 76 and 78 and leg sections 60 and 62 of each of the metal retainer pins 40 ensures that the opposite end sections 82 and 84 of the metal pins are firmly held by the mold wall sections 44 and 46.

The metal retainer pins 40 retain the mold wall sections 44 and 46 against movement relative to each other during firing of the mold structure 10. During firing of the mold structure 10, the end portions 82 and 84 of the metal retainer pins 40 transmit force to the portions 66 of the metal retainer pin which spans the mold cavity 18. By transmitting force between the mold wall sections 44 and 46, the metal retainer pins 40 prevent deformation of the mold wall sections from the pressures developed during firing and removal of the pattern 50. The platinum metal of the retainer pins 40 does not oxidize during firing of the mold structure 10.

Once the mold structure 10 has been formed in the manner previously described, molten metal is poured into the mold structure through the pour cup 22 (FIG. 1). Although many different metals could be utilized, the molten metal was a nickel-chrome super alloy. The molten metal flows from the pour cup 22 into the mold cavity 18 (FIG. 6). The pouring of the molten metal into the mold structure 10 may be performed in an evacuated environment in order to avoid contamination of the molten metal.

As the molten metal enters the mold cavity 18, the molten metal applies force against the side surfaces 80 and 81 on the mold wall sections 44 and 46. The pressure applied against the mold wall sections 44 and 46 urges the mold wall sections away from each other. However, the metal retainer pins 40 are effective to retain the mold wall sections 44 and 46 against movement relative to each other under the influence of the force applied against the mold wall sections by the molten metal.

The force applied against the mold wall sections 44 and 46 by the molten metal in the mold cavity 18 urges the mold wall sections 44 and 46 away from each other. This results in the main or central sections of the metal retainer pins 40 being tensioned to transmit force between the mold wall sections 44 and 46. The force transmitted between the mold wall sections 44 and 46 through the retainer pins 40 prevents relative movement between the mold wall sections 44 and 46.

Figure 7:
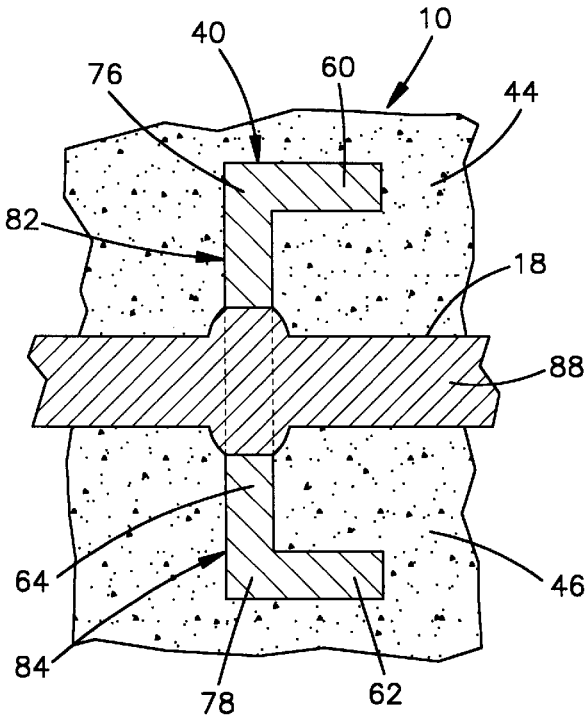
FIG. 7 is a fragmentary schematic illustration depicting the manner in which molten metal is solidified in the mold cavity and the manner in which a metallurgical bond is formed between the metal in the mold cavity and the metal retainer pin.

Since the mold wall sections 44 and 46 do not move relative to each other during pouring and subsequent solidi fication of metal 88 in the mold structure 10, the cast metal article, that is, the thin metal panel 12, is accurately formed with the desired dimensions. As the metal 88 solidifies in the mold cavity 18, the metal forming the pins 40 is at least partially melted and absorbed into the molten metal 88 (FIG. 7). This results in the establishment of a solid metallurgical bond, which has been indicated in dashed lines in FIG. 7, between the metal retainer pins 40 and the metal 88. The metallurgical bonding and the platinum material of the pins 40 ensures that the pins 40 do not significantly impair the characteristics of the cast thin metal panel 12.

Although the foregoing description has been in conjunction with the casting of a thin metal panel 12 formed of a reactive metal, specifically a nickel-chrome super alloy, metal retainer pins having a construction similar to the metal retainer pins 40 could be utilized in many different types of mold structures during the casting of many different types of articles from many different metals. For example, relatively large metal retainer pins 40 could be spaced relatively large distances apart and used to hold mold wall sections of a mold structure in which a relatively thick article is cast. The relatively thick article could be cast from any desired metal. Of course, the metal retainer pins 40 would be formed of a metal which would not react with the metal from which the article is to be cast and would be capable of withstanding the relatively high temperatures of the molten metal poured into the mold cavity during initial solidification of the molten metal.

CONCLUSION

The present invention provides a new and improved method and apparatus for use in casting a metal article, such as the thin metal panel 12. The apparatus includes a mold structure 10 having one or more metal pins 40 which extend between wall sections 44 an d 46 of the mold structure. Bent end portions 82 and 84 of the pins 40 are disposed in the mold wall sections 44 and 46. Central or connector portions 64 of the pins a re disposed in the mold cavity 18 and extend between the mold wall sections 44 and 46. Force is transmitted through the pins 40 to retard relative movement between the mold wall sections 44 and 46 during casting of the metal article 12.

Although the method and apparatus of the present invention may be utilized to cast many different types of articles, it is believed that the apparatus will be particularly advantageous for forming of castings having thin wall areas. Thus, the method and apparatus may be used to cast a metal article 12 having thin wall areas 30 with a thickness of 0.060 inches or less. The thin wall article 12 has a length and width of at least four inches or more. Although the metal pins 40 may have many different dimensions, it may be preferred to use metal pins having a thickness of 0.30 inches or less.

Having described the invention, the following is claimed:

1. An apparatus for use in casting a metal article, said apparatus comprising a ceramic mold structure having first and second sections with a mold cavity which receives molten metal disposed between the first and second sections of said mold structure, and a metal pin having a first end portion disposed in the first section of said mold structure, a second end portion disposed in the second section of said mold structure, and a third portion which extends between said first and second end portions of said metal pin and which extends across the mold cavity, said third portion of said metal pin being effective to transmit force between said first and second end portions of said metal pin to retard relative movement between said first and second sections of said mold structure, said third portion of said metal pin has a longitudinal central axis, said first end portion of said metal pin includes a first bend and a first leg portion, said first leg portion extends transverse to the longitudinal central axis of said third portion of aid metal pin and is connected with said third portion of said metal pin by said first bend, said second end portion of said metal pin includes a second bend and a second leg portion, said second leg portion extends transverse to the longitudinal central axis of said third portion of said metal pin and is connected with said third portion of said metal pin by said second bend, said first and second leg portions of said metal pin being embedded in said mold structure, where said first section of said ceramic mold structure has a first flat surface area, said second section of said ceramic mold structure has a second flat surface area which extends parallel to said first flat surface area, said third portion of said metal pin having a longitudinal central axis which extends through a plane containing said first flat surface area and through a plane containing said second flat surface area, said first and second flat surface areas being spaced apart for defining thickness of the mold cavity by a distance of 0.060 inches of less as measured along an axis extending perpendicular to said first and second flat surface areas.

2. An apparatus as set forth in claim 1 wherein said metal pin contains platinum.

3. An apparat us as set forth in claim 1 wherein said first end portion of said metal pin is completely enclosed by said first section of said mold structure, said second end portion of said metal pin is completely enclosed by said second section of said mold structure.

4. An apparatus as set forth in claim 1 wherein said third portion of said metal pin has a cylindrical configuration with a diameter of 0.030 inches or less.

5. An apparatus as set forth in claim 4 wherein said metal pin has an overall length of one inch or less.

* * * * *